US008347760B2

(12) United States Patent
Yu

(10) Patent No.: US 8,347,760 B2
(45) Date of Patent: Jan. 8, 2013

(54) RATCHET DEVICE WITH STABLE STRUCTURE

(75) Inventor: Hon Tsao Yu, Taichung (TW)

(73) Assignee: Zheng Cong Jiang, Taichung (TW)

( * ) Notice: Subject to any disclaimer, the term of this patent is extended or adjusted under 35 U.S.C. 154(b) by 0 days.

(21) Appl. No.: 13/301,787

(22) Filed: Nov. 22, 2011

(65) Prior Publication Data

US 2012/0279363 A1 Nov. 8, 2012

(30) Foreign Application Priority Data

May 6, 2011 (TW) ..... 100208146 U

(51) Int. Cl.
*B25B 13/46* (2006.01)
*B25B 13/00* (2006.01)

(52) U.S. Cl. ..... 81/119; 81/63; 81/63.1; 81/63.2; 81/59.1

(58) Field of Classification Search ..... 81/63, 63.2, 81/59.1, 63.1; 192/43.1
See application file for complete search history.

(56) References Cited

U.S. PATENT DOCUMENTS

| | | | | |
|---|---|---|---|---|
| 4,602,534 | A * | 7/1986 | Moetteli | 81/177.85 |
| 5,086,673 | A * | 2/1992 | Korty | 81/59.1 |
| 5,884,537 | A * | 3/1999 | Chen | 81/58.4 |
| 6,357,323 | B2 * | 3/2002 | Chi et al. | 81/60 |
| 7,077,032 | B1 * | 7/2006 | Lee | 81/62 |
| 7,216,568 | B1 * | 5/2007 | Hsieh | 81/63.2 |
| 2011/0120272 | A1 * | 5/2011 | Peng et al. | 81/63.1 |

* cited by examiner

*Primary Examiner* — Monica Carter
*Assistant Examiner* — Danny Hong

(57) ABSTRACT

A ratchet device with stable structure includes a control unit, at least three receiving spaces defined on the top plane of the control unit, the receiving spaces communicating with each other, a pair of blockers and a elastomer located in each receiving space, a ratchet unit connected to the control unit, the ratchet unit having a spindle formed at one end thereof, a plurality of teeth formed around the periphery of the ratchet unit, the teeth engaged with the blockers of the control unit; a switching unit connected to the ratchet unit, at least three push sticks extruded from the bottom of the switching unit for pushing against the blockers. Therefore, the amounts of engaging faces among the blockers and the teeth are as enough as possible to make the engagement between the blockers and the teeth stable during an external torsion.

15 Claims, 11 Drawing Sheets

RATCHET DEVICE WITH STABLE STRUCTURE

BACKGROUND OF THE INVENTION

1. Field of the Invention

The present invention relates to a ratchet device, and more particularly to a ratchet device with stable structure.

2. Description of Related Art

A conventional ratchet device comprises a control unit 21. The control unit 21 has a central hole 211 opened there through. Two pairs of side grooves (a first side groove 212A, a second side groove 212B, a third side groove 213A, a fourth side groove 213B) defined on two sides of the central hole 211 of the control unit 21. The side grooves 212A, 212B, 213A, 213B communicates with the central hole 211. A first elastomer 22A, a second elastomer 22B, a third elastomer 23A and a fourth elastomer 23B are respectively received in the first side groove 212A, the second side groove 212B, the third side groove 213A and the fourth side groove 213B. A first blocker 24A, a second blocker 24B, a third blocker 25A and a fourth blocker 25B are respectively received in the first side groove 212A, the second side groove 212B, the third side groove 213A and the fourth side groove 213B. A first protrusion 241A, a second protrusion 241B, a third protrusion 251A and a fourth protrusion 251B are respectively extruded at one ends of the first blocker 24A, the second blocker 24B, the third blocker 25A and the fourth blocker 25B. A first engaging portion 242A, a second engaging portion 242B, a third engaging portion 252A and a fourth engaging portion 252B are respectively formed at another ends of the first blocker 24A, the second blocker 24B, the third blocker 25A and the fourth blocker 25B. The control unit 21 has a receiving hole 214 opened on the outside periphery thereof. The receiving hole 214 receives a fifth elastomer 26 and a bead 27. A ratchet unit 28 is located in the central hole 211 of the control unit 21. A polygonal hole 281 is opened at one end of the ratchet unit 28. A plurality of teeth 282 are formed around the periphery of the ratchet unit 28. The engaging portions 242A, 242B, 252A, 252B engage with the teeth 282. The control unit 21 is encircled by a switching unit 29. The switching unit 29 has a first push portion 291A, a second push portion 291B, a third push portion 292A and a fourth push portion 292B, those are respectively corresponding to the first protrusion 241A, the second protrusion 241B, the third protrusion 251A and the fourth protrusion 251B. When the push portions 291A, 291B, 292A, 292B push against the protrusions 241A, 241B, 251A, 251B respectively, the blockers 24A, 24B, 25A, 25B move along the side grooves 212A, 212B, 213A, 213B respectively. A first engaging groove 293A, a second engaging groove 293B and a third engaging groove 293C are defined on the inner periphery of the switching unit 29. The bead 27 of the control unit 21 is selectively engaged with one of the engaging grooves 293A, 293B, 293C. When a user rotates the switching unit 29 clockwise, the third push portion 292A and the fourth push portion 292B of the switching unit 29 push against the third blocker 25A and the fourth blocker 25B respectively, and the third blocker 25A and the fourth blocker 25B move along the third side groove 213A and the fourth side groove 213B respectively, so that the third engaging portion 252A and the fourth engaging portion 252B are disengaged with the teeth 282, and the first engaging portion 242A and the second engaging portion 242B keep being engaged with the teeth 282, thereafter the bead 27 is engaged with the first engaging groove 293A. Under this arrangement, when the user rotates the control unit 21 clockwise to operate, the ratchet unit 28 rotates with the rotation of the control unit 21, because the first engaging portion 242A and the second engaging portion 242B are engaged with the teeth 282; when the user rotates the control unit 21 counterclockwise to operate, the ratchet unit 28 does not rotate with the rotation of the control unit 21 because the first engaging portion 242A and the second engaging portion 242B are respectively moved toward the first elastomer 22A and the second elastomer 22B by the pushing from the teeth 282. Thus, the first engaging portion 242A and the second engaging portion 242B are disengaged with the teeth 282 step by step by the compression of the first elastomer 22A and the second elastomer 22B. However, the conventional ratchet device has one shortcoming as following:

Because the engaging faces between one pair of the engaging portions 242A, 242B, 252A, 252B and the teeth 282 are too few to make the engagement between one pair of the engaging portions 242A, 242B, 252A, 252B and the teeth 282 stable for suffering a large torsion. The engaging portions 242A, 242B, 252A, 252B or the teeth 282 might be broken if the external torsion were over the strength of the structure among the engaging portions 242A, 242B, 252A, 252B and the teeth 282.

The present invention has arisen to mitigate and/or obviate the disadvantages of the conventional. Further benefits and advantages of the present invention will become apparent after a careful reading of the detailed description with appropriate reference to the accompanying drawings.

SUMMARY OF THE INVENTION

The main objective of the present invention is to provide an improved ratchet device.

To achieve the objective, a ratchet device with stable structure comprises a control unit, at least three receiving spaces defined on the top plane of the control unit, the receiving spaces communicating with each other, a pair of blockers and a elastomer located in each receiving space, a ratchet unit connected to the control unit, the ratchet unit having a spindle formed at one end thereof, a plurality of teeth formed around the periphery of the ratchet unit, the teeth engaged with the blockers of the control unit, a switching unit connected to the ratchet unit, at least three push sticks extruded from the bottom of the switching unit for pushing against the blockers, at least three receiving grooves respectively defined between each two of the receiving spaces and the receiving grooves respectively corresponding to the corresponding push sticks of the switching unit, the receiving spaces being symmetrical to each other, the cross-section of each one of the receiving spaces being almost triangle-shaped, each blocker having an engaging portion, each elastomer of the control unit being a spring, a receiving hole being opened on the top plane of the control unit for receiving a fourth elastomer and a bead, three engaging grooves defined on the bottom of the switching unit, the bead of the control unit selectively engaged with one of the engaging grooves, a first central hole opened on the control unit there through, the cross-section of the spindle of the ratchet unit being tetragon-shaped, a second circular groove defined around the periphery of the spindle, the spindle passing through the first central hole of the control unit, a first connecting ring engaged with the second circular groove of the spindle for connecting the spindle to the control unit, the first connecting ring having a notch, the ratchet unit having a cylindrical-shaped connecting end formed at another end thereof, a first circular groove defined around the periphery of the connecting end, a second central hole opened through the switching unit, the switching unit encircling the connecting end of the ratchet unit via the second central hole, a second connecting ring engaged with the first circular groove of the ratchet unit for connecting the switching unit to the ratchet unit, the second connecting ring having a notch, a rod extruded on the outside periphery of the control unit, a connecting portion extruded from the top plane of a control unit, a pivot rod pivoted on the connecting portion, a connecting portion extruded from the top plane of a control unit for connecting the control unit to a handle bar, a ratchet unit mounted to the control unit, a second connecting hole opened at the head of the ratchet unit, the cross-section of the second connecting hole being hexagon-shaped, the second connecting hole encircling the tool bit for connecting the tool bit to the ratchet unit, the cross-section of the connecting portion being polygon-shaped, the handle bar having a first connecting hole opened at one end thereof, the cross-section of the first connecting hole being polygon-shaped, the connecting portion of the control unit inserted into the first connecting hole of the handle bar for connecting the control unit to the handle bar.

Further benefits and advantages of the present invention will become apparent after a careful reading of the detailed description with appropriate reference to the accompanying drawings.

DETAILED DESCRIPTION OF THE INVENTION

Figure 1:
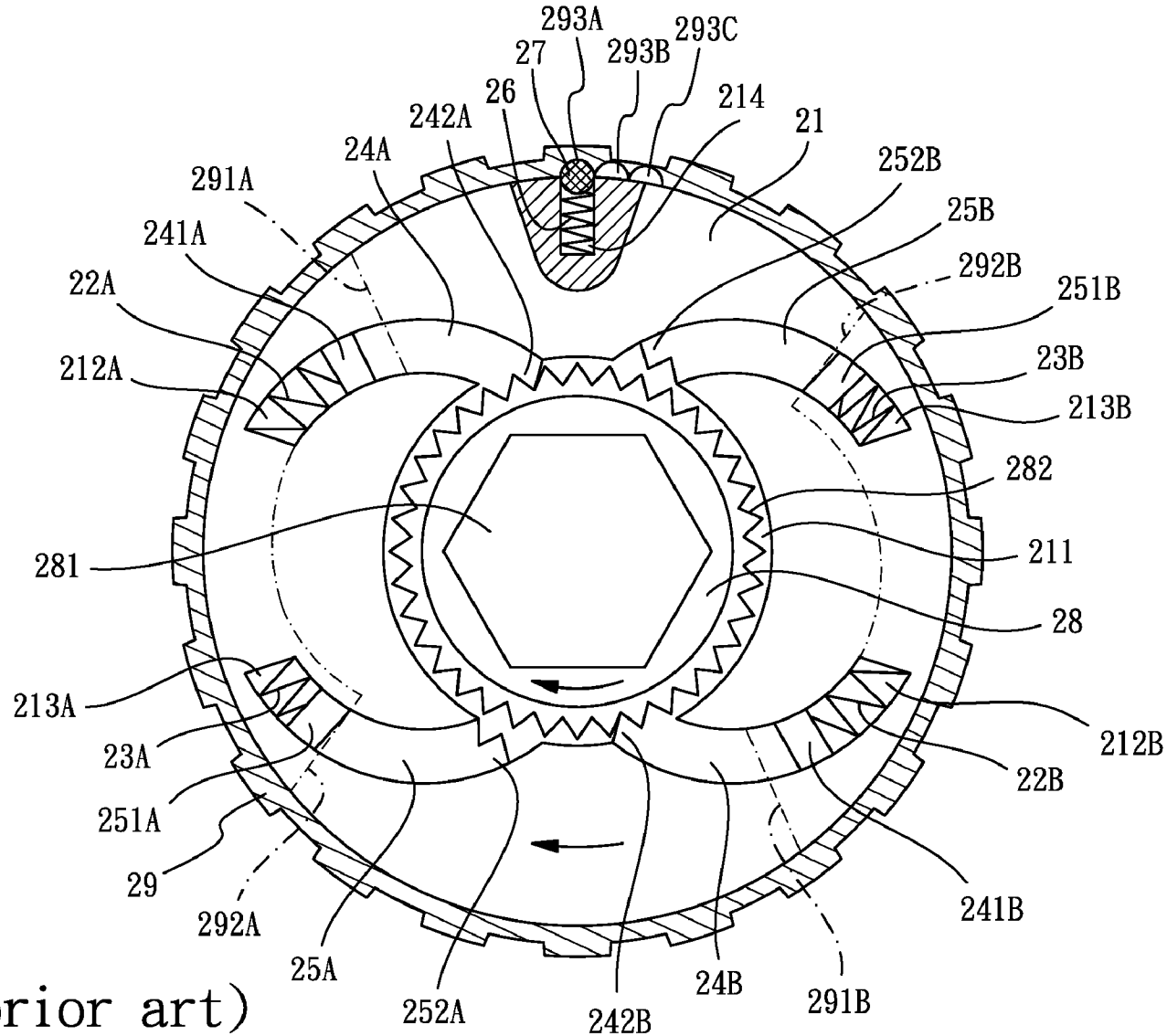
FIG. 1(prior art)
FIG. 1 is a cross-sectional view of a conventional ratchet device of the prior art.
Figure 2:
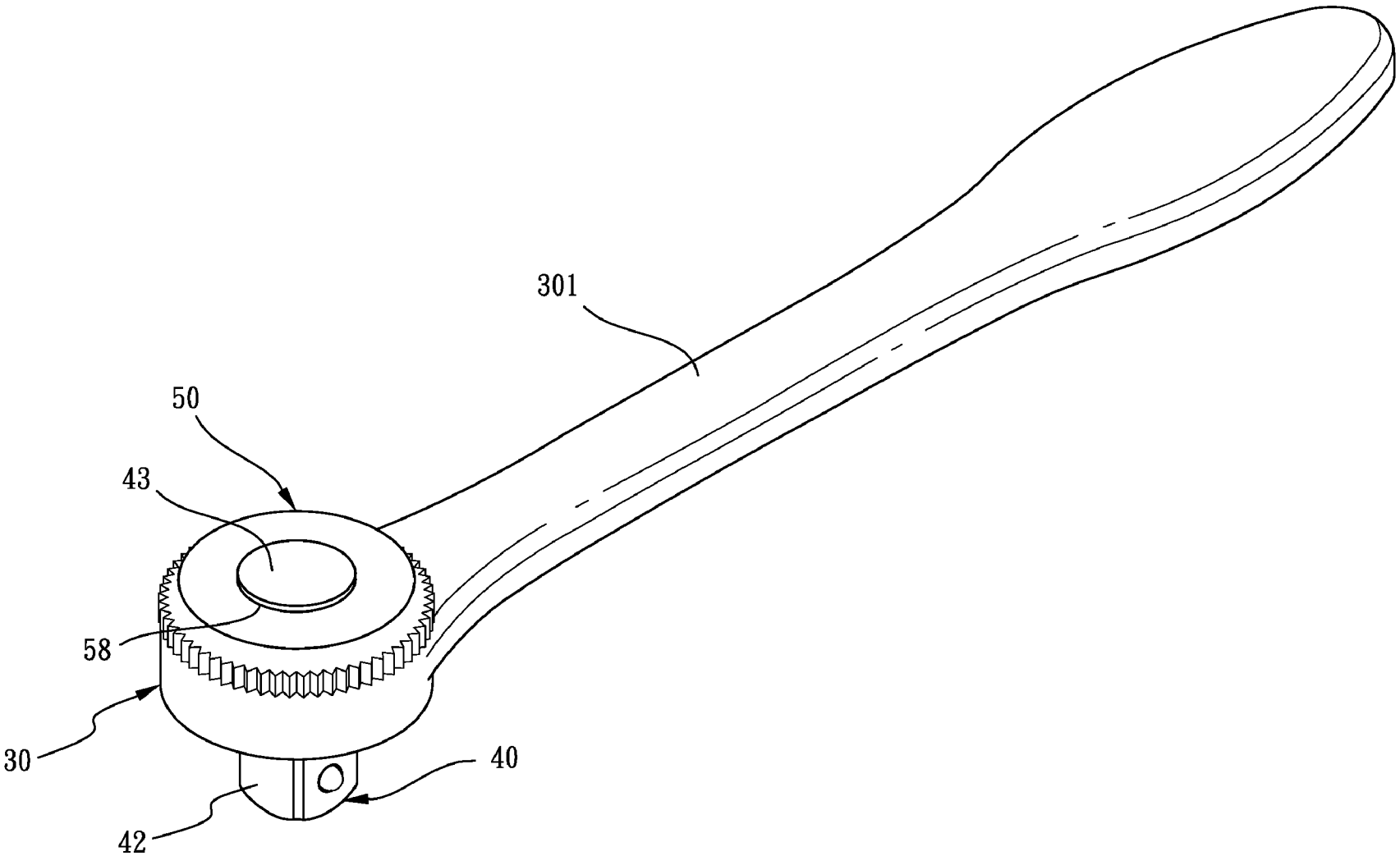
FIG. 2 is a perspective view of a ratchet device with stable structure of the present invention.
Figure 3:
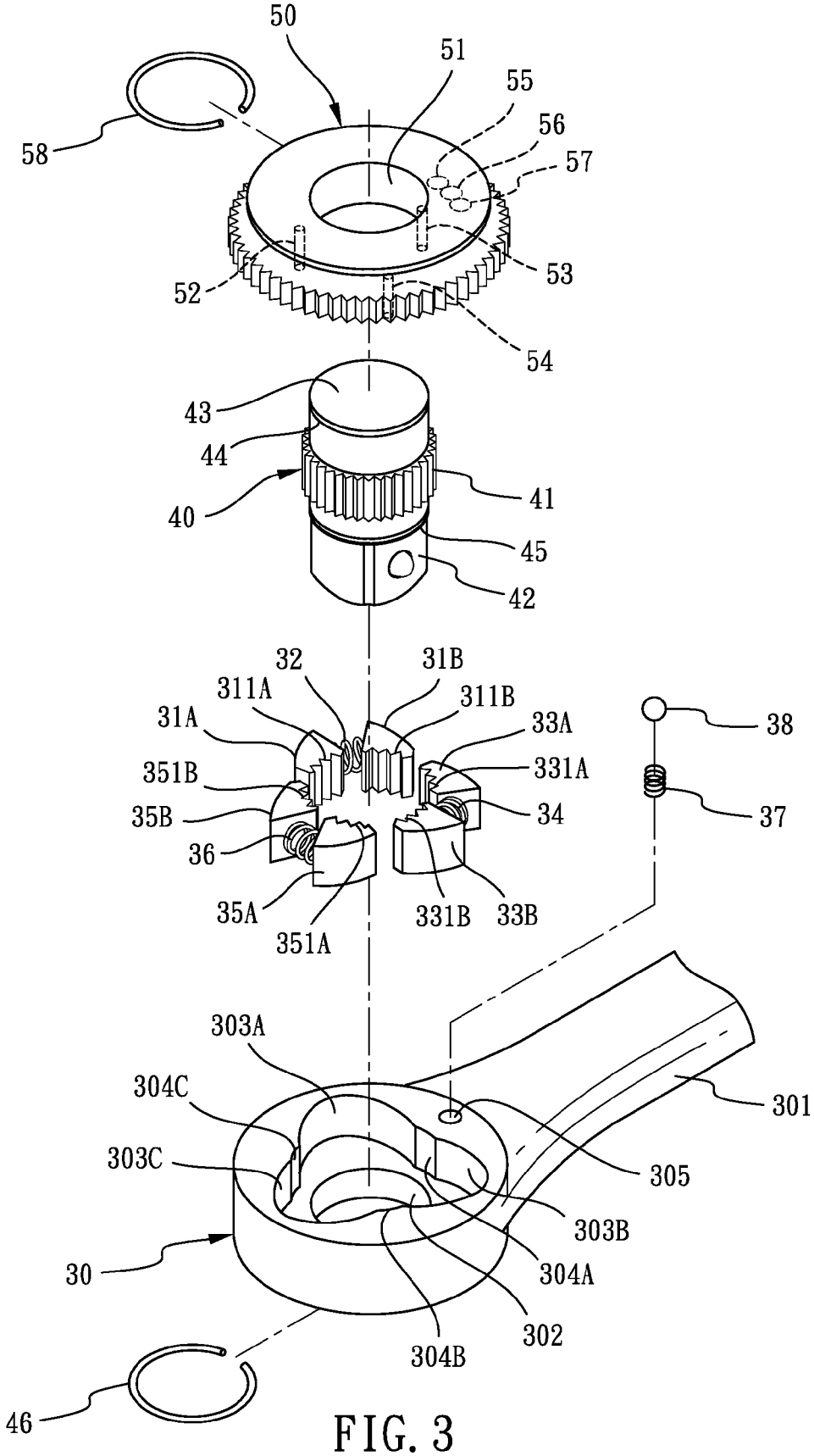
FIG. 3 is an exploded view of the ratchet device with stable structure.
Figure 4:
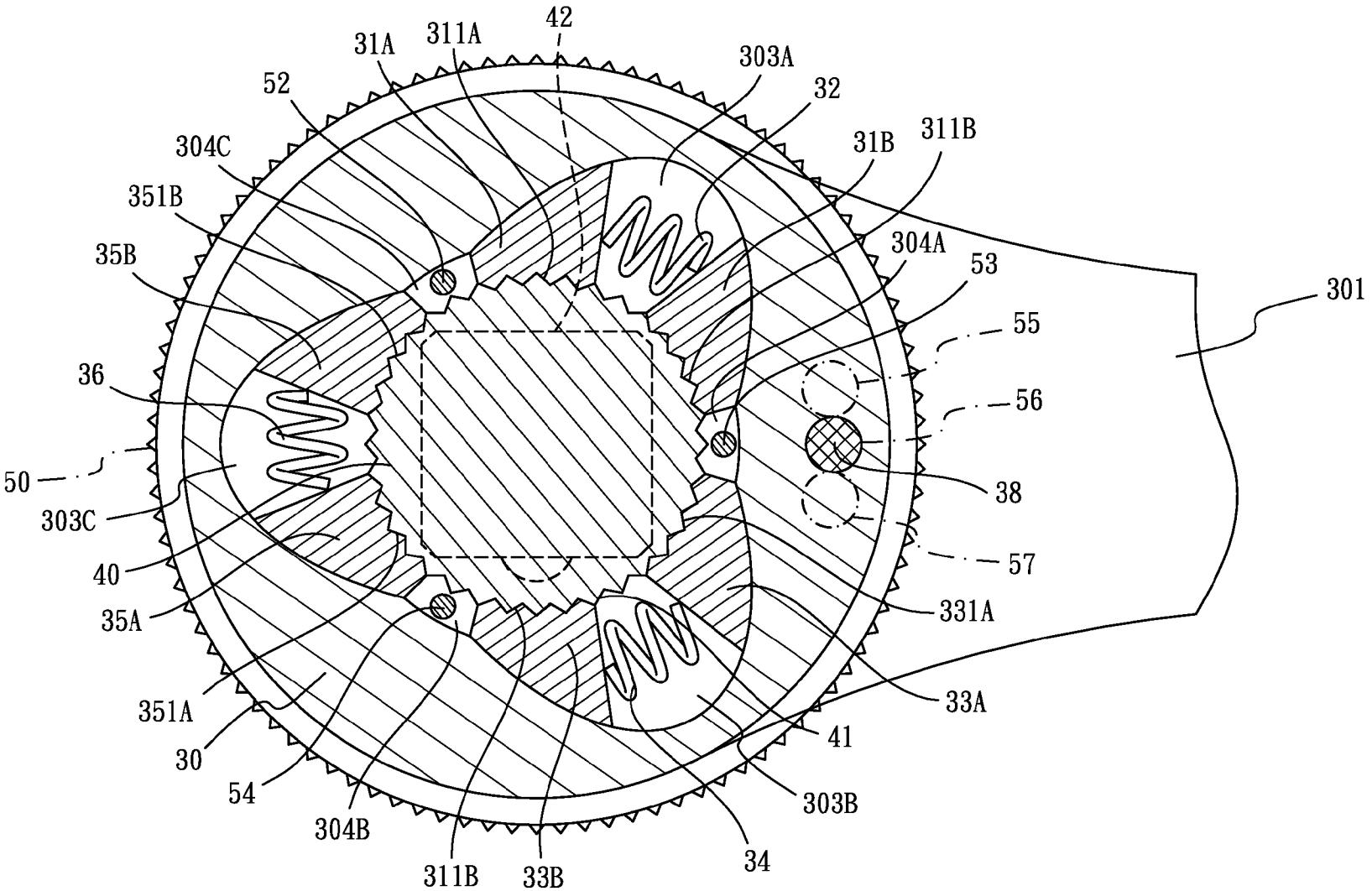
FIG. 4 is a cross-sectional view of the ratchet device with stable structure.

Referring to FIGS. 2-4, a ratchet device with stable structure in accordance with the present invention comprises a control unit 30, a ratchet unit 40 and a switching unit 50. A rod 301 is extruded on the outside periphery of the control unit 30 for a user to handle. A first central hole 302 is opened on the control unit 30 there through. At least three receiving spaces (a first receiving space 303A, a second receiving space 303B and a third receiving space 303C are presented in this embodiment) are defined on the top plane of the control unit 30. The receiving spaces 303A, 303B, 303C communicate with each other and communicate with the first central hole 302. The angle between the receiving spaces 303A and 303B, 303B and 303C, or 303C and 303A is 120 degree in this embodiment. The cross-section of each one of the receiving spaces 303A, 303B, 303C is almost triangle-shaped. At least three receiving grooves (a first receiving groove 304A, a second receiving groove 304B and a third receiving groove 304C are presented in this embodiment) are respectively defined between the adjacent two of the receiving spaces 303A, 303B, 303C. The first receiving groove 304A is defined between the first receiving space 303A and the second receiving space 303B; the second receiving groove 304B is defined between the second receiving space 303B and the third receiving space 303C; the third receiving groove 304C is defined between the first receiving space 303A and the third receiving space 303C. A first blocker 31A with a first engaging portion 311A and a second blocker 31B with a second engaging portion 311B are located in the first receiving space 303A, and a first elastomer 32 is located between the first blocker 31A and the second blocker 31B. A third blocker 33A with a third engaging portion 331A and a fourth blocker 33B with a fourth engaging portion 331B are located in the second receiving space 303B, and a second elastomer 34 is located between the third blocker 33A and the fourth blocker 33B. A fifth blocker 35A with a fifth engaging portion 351A and a sixth blocker 35B with a sixth engaging portion 351B are located in the third receiving space 303C, and a third elastomer 36 is located between the fifth blocker 35A and the sixth blocker 35B. The three pairs of the blockers, 31A and 31B, 33A and 33B, 35A and 35B are symmetrical to each other. A receiving hole 305 is opened on the top plane of the control unit 30 for receiving a fourth elastomer 37 and a bead 38 (the elastomers 32, 34, 36, 37 are the springs in this embodiment). A plurality of teeth 41 are formed around the periphery of the ratchet unit 40. The ratchet unit 40 has a spindle 42 formed at one end thereof. The ratchet unit 40 has a connecting end 43 formed at another end thereof. The cross-section of the spindle 42 of the ratchet unit 40 is tetragon-shaped in this embodiment. The spindle 42 connects to a tool bit (not shown). The connecting end 43 is cylindrical-shaped. A first circular groove 44 is defined around the periphery of the connecting end 43. A second circular groove 45 is defined around the periphery of the spindle 42. The spindle 42 of the ratchet unit 40 passes through the first central hole 302 of the control unit 30. The engaging portions 311A, 311B, 331A, 331B, 351A, 351B of the blockers 31A, 31B, 33A, 33B, 35A, 35B engage with the teeth 41. A first connecting ring 46 with a notch is engaged with the second circular groove 45 of the spindle 42 for connecting the spindle 42 to the control unit 30. A second central hole 51 is opened through the switching unit 50. At least three push sticks (a first push stick 52, a second push stick 53 and a third push stick 54 are presented in this embodiment) are extruded from the bottom of the switching unit 50. The first push stick 52, the second push stick 53 and the third push stick 54 of the switching unit 50 are respectively corresponding to the first receiving groove 304A, the second receiving groove 304B and the third receiving groove 304C of the control unit 30. The first push stick 52, the second push stick 53 and the third push stick 54 of the switching unit 50 are respectively received in the first receiving groove 304A, the second receiving groove 304B and the third receiving groove 304C of the control unit 30. The first push stick 52 pushes against the first blocker 31A or the sixth blocker 35B; the second push stick 53 pushes against the second blocker 31B or the third blocker 33A; the third push stick 54 pushes against the fourth blocker 33B or the fifth blocker 35A. A first engaging groove 55, a second engaging groove 56 and a third engaging groove 57 are defined on the bottom of the switching unit 50. The bead 38 of the control unit 30 is selectively engaged with one of the engaging grooves 55, 56, 57. The switching unit 50 encircles the connecting end 43 of the ratchet unit 40 via the second central hole 51. The switching unit 50 caps the control unit 30 and the push sticks 52, 53, 54 of the switching unit 50 are respectively inserted into the corresponding receiving grooves 304A, 304B, 304C of the control unit 30. The bead 38 of the control unit 30 is engaged with the second engaging groove 56 of the switching unit 50. A second connecting ring 58 with a notch is engaged with the first circular groove 44 of the ratchet unit 40 for connecting the switching unit 50 to the ratchet unit 40 so that the ratchet unit 40 is positioned between the control unit 30 and the switching unit 50.

Figure 5:
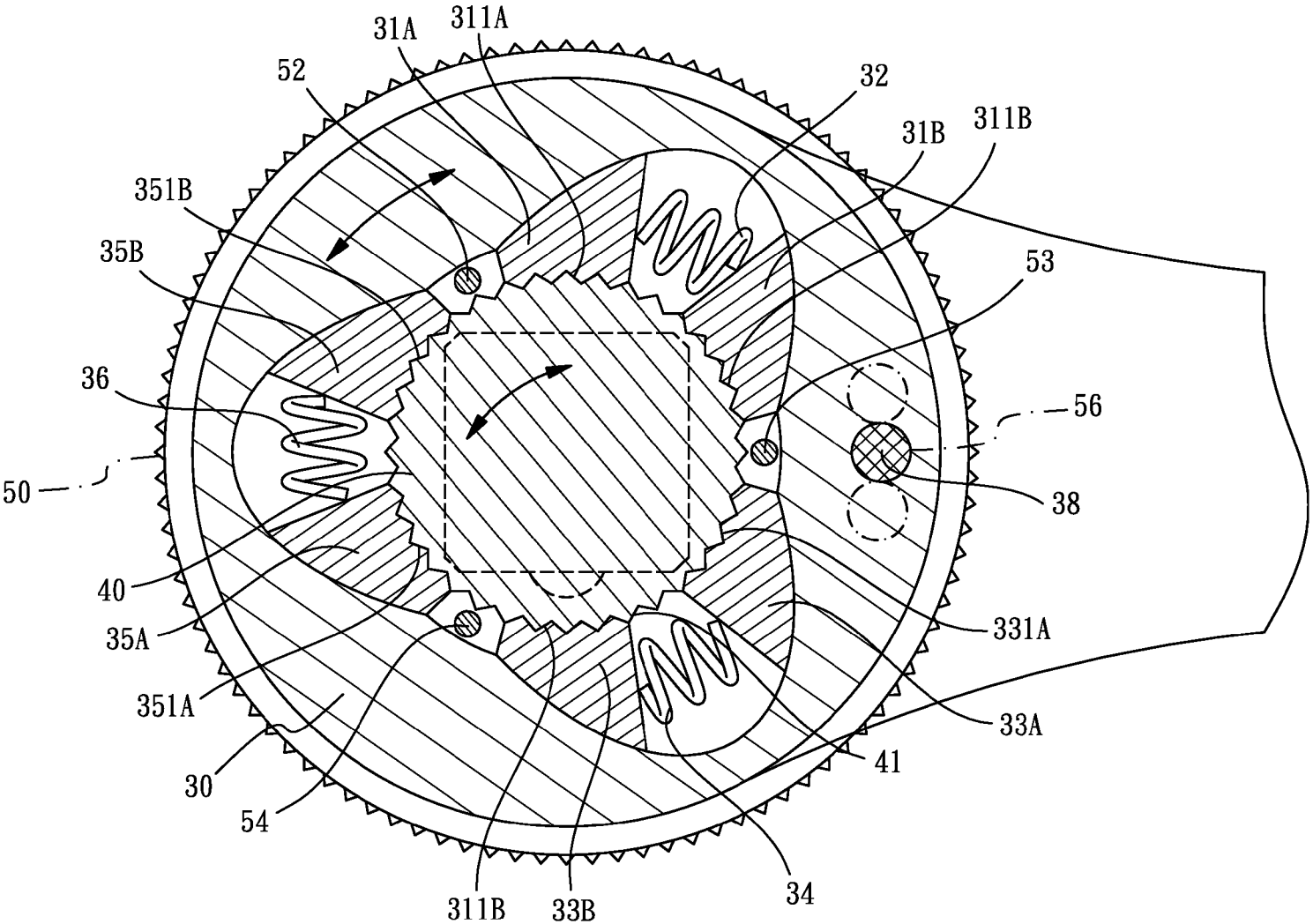
FIG. 5 is a cross-sectional view of the ratchet device with stable structure for showing the operating under the two-way rotating mode.

Referring to FIG. 5, when the user does not rotate the switching unit 50 and the bead 38 is engaged with the second engaging groove 56 of the switching unit 50, the push sticks 52, 53, 54 do not push against the blockers 31A, 31B, 33A, 33B, 35A, 35B and the blockers 31A, 31B, 33A, 33B, 35A, 35B do not move away from the ratchet unit 40 so that the engaging portions 311A, 311B, 331A, 331B, 351A, 351B keep being engaged with the teeth 41 of the ratchet unit 40. Under this arrangement, when the user rotates the control unit 30 clockwise or counterclockwise to operate, the ratchet unit 40 rotates with the rotation of the control unit 30 because the blockers 31A, 31B, 33A, 33B, 35A, 35B engage with the teeth 41 of the ratchet unit 40.

Figure 6:
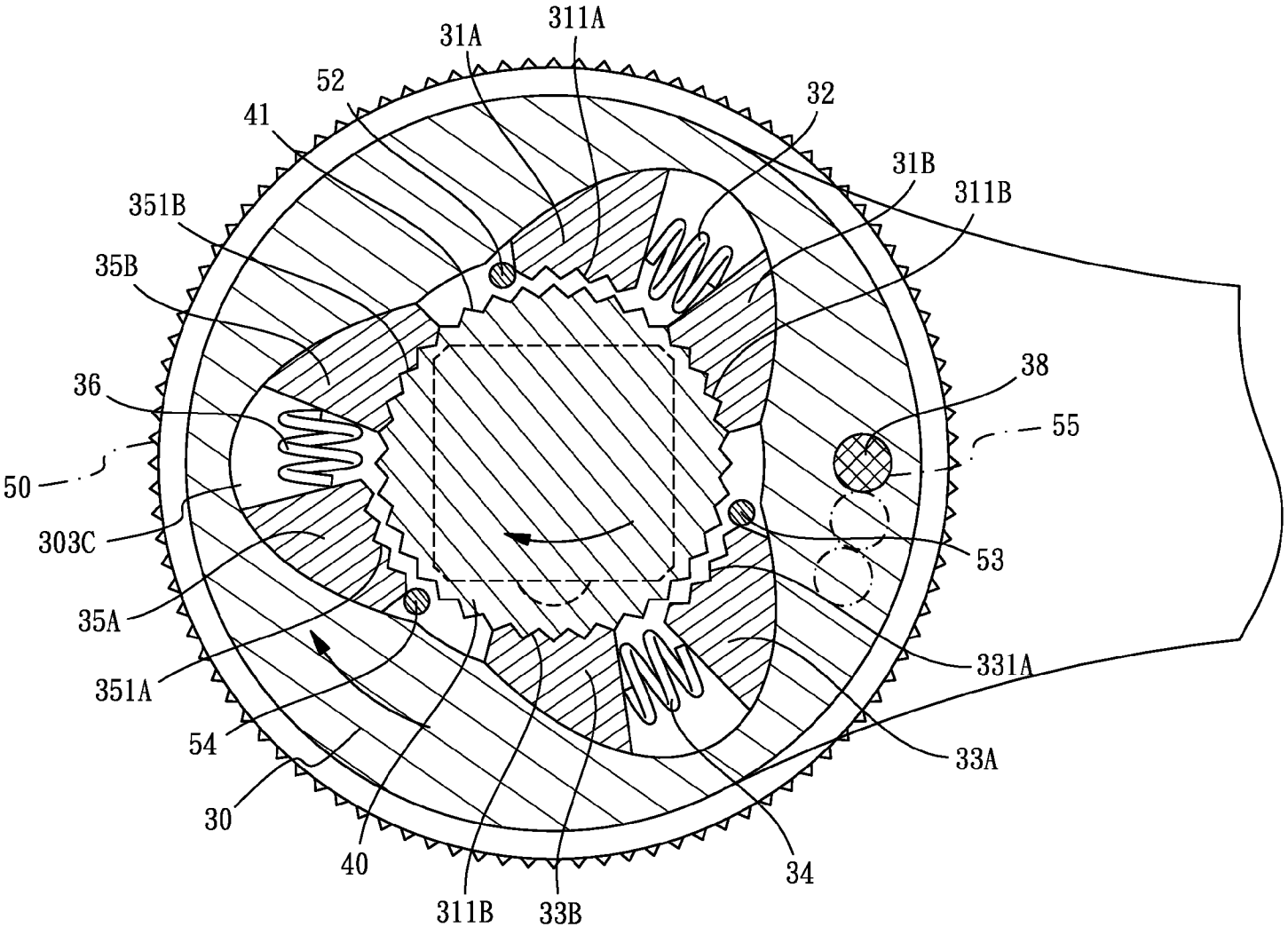
FIG. 6 is a cross-sectional view of the ratchet device with stable structure for showing the operating under the counter-clockwise rotating mode.

Referring to FIG. 6, when the user rotates the switching unit 50 clockwise, the first push stick 52, the second push stick 53 and the third push stick 54 respectively push against the first blocker 31A, the third blocker 33A and the fifth blocker 35A. The first blocker 31A, the third blocker 33A and the fifth blocker 35A are moved away from the ratchet unit 40 and respectively press against the ends of the first elastomer 32, the second elastomer 34 and the third elastomer 36 so that the first engaging portion 311A, the third engaging portion 331A and the fifth engaging portion 351A are disengaged with the teeth 41 of the ratchet unit 40 and the second engaging portion 311B. The fourth engaging portion 331B and the sixth engaging portion 351B keep being engaged with the teeth 41 of the ratchet unit 40. Thereafter the bead 38 is engaged with the first engaging groove 55 of the switching unit 50. Under this arrangement, when the user rotates the control unit 30 clockwise to operate, the ratchet unit 40 rotates with the rotation of the control unit 30 because the second engaging portion 311B, the fourth engaging portion 331B and the sixth engaging portion 351B are engaged with the teeth 41 of the ratchet unit 40; when the user rotates the control unit 30 counterclockwise to operate, the ratchet unit 40 does not rotate with the rotation of the control unit 30 because the second engaging portion 311B, the fourth engaging portion 331B and the sixth engaging portion 351B are respectively moved toward the first elastomer 32, the second elastomer 34 and the third elastomer 36 by the pushing from the teeth 41. Thus, the second engaging portion 311B, the fourth engaging portion 331B and the sixth engaging portion 351B are disengaged with the teeth 41 step by step by the compression of the first elastomer 32, the second elastomer 34 and the third elastomer 36.

Figure 7:
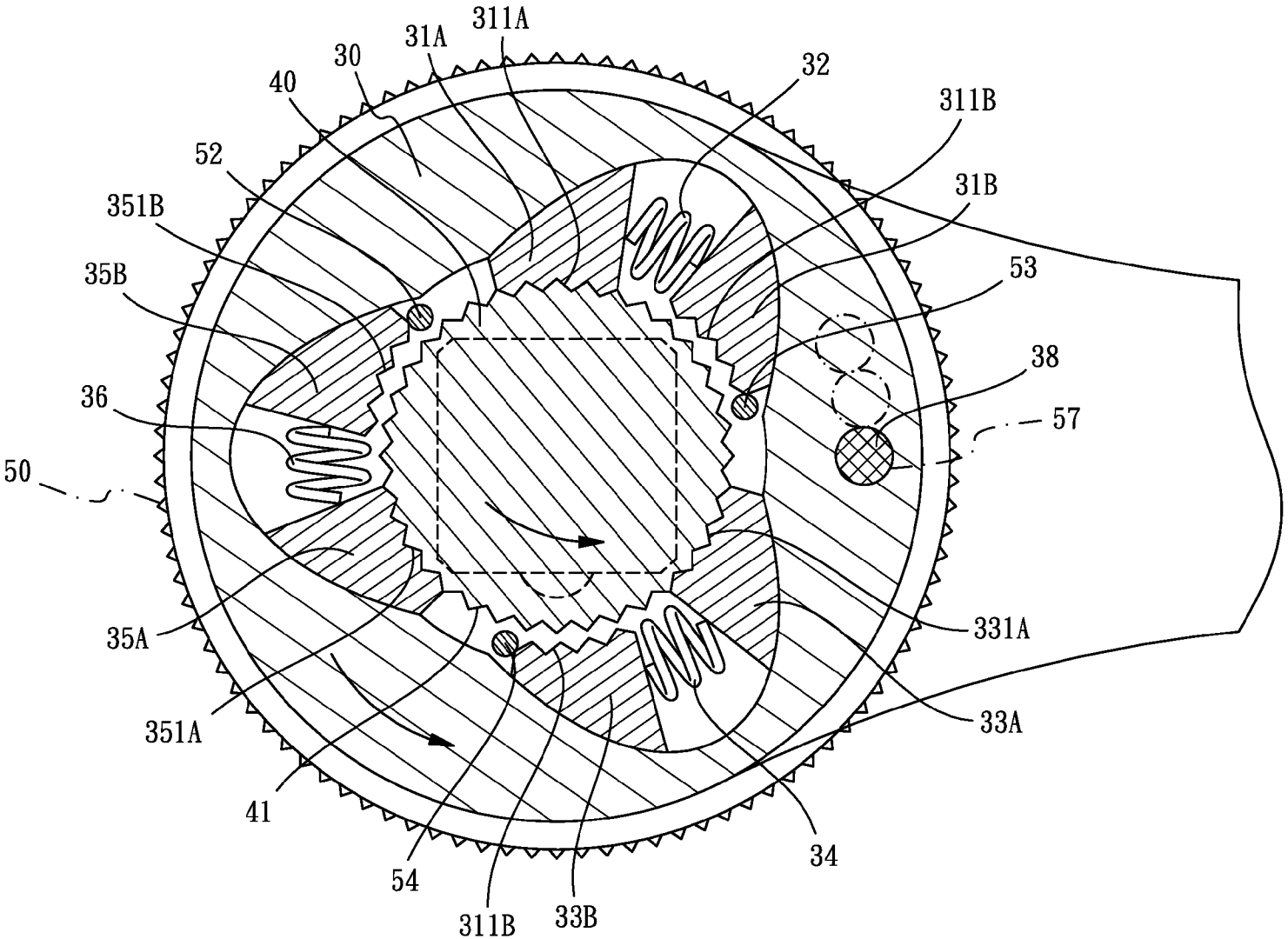
FIG. 7 is a cross-sectional view of the ratchet device with stable structure for showing the operating under the clockwise rotating mode.

Referring to FIG. 7, when the user rotates the switching unit 50 counterclockwise, the first push stick 52, the second push stick 53 and the third push stick 54 respectively push against the second blocker 31B, the fourth blocker 33B and the sixth blocker 35B. The second blocker 31B, the fourth blocker 33B and the sixth blocker 35B are moved away from the ratchet unit 40 and respectively press against the other ends of the first elastomer 32, the second elastomer 34 and the third elastomer 36 so that the second engaging portion 311B, the fourth engaging portion 331B and the sixth engaging portion 351B are disengaged with the teeth 41 of the ratchet unit 40 and the first engaging portion 311A. The third engaging portion 331A and the fifth engaging portion 351A keep being engaged with the teeth 41 of the ratchet unit 40. Thereafter the bead 38 is engaged with the third engaging groove 57 of the switching unit 50. Under this arrangement, when the user rotates the control unit 30 counterclockwise to operate, the ratchet unit 40 rotates with the rotation of the control unit 30 because the first engaging portion 311A, the third engaging portion 331A and the fifth engaging portion 351A are engaged with the teeth 41 of the ratchet unit 40; when the user rotates the control unit 30 clockwise for operating, the ratchet unit 40 does not rotate with the rotation of the control unit 30 because the first engaging portion 311A, the third engaging portion 331A and the fifth engaging portion 351A are respectively moved toward the first elastomer 32, the second elastomer 34 and the third elastomer 36 by the pushing from the teeth 41 and are disengaged with the teeth 41 step by step by the compression of the first elastomer 32, the second elastomer 34 and the third elastomer 36.

Therefore, the amounts of engaging faces among the six engaging portions 311A, 311B, 331A, 331B, 351A, 351B and the teeth 41 are as enough as possible to make the engagement between the engaging portions 311A, 311B, 331A, 331B, 351A, 351B and the teeth 41 stable during an external torsion. Thus, the engaging portions 311A, 311B, 331A, 331B, 351A, 351B or the teeth 41 would not be broken easily during the larger external torsion acting.

Figure 8:
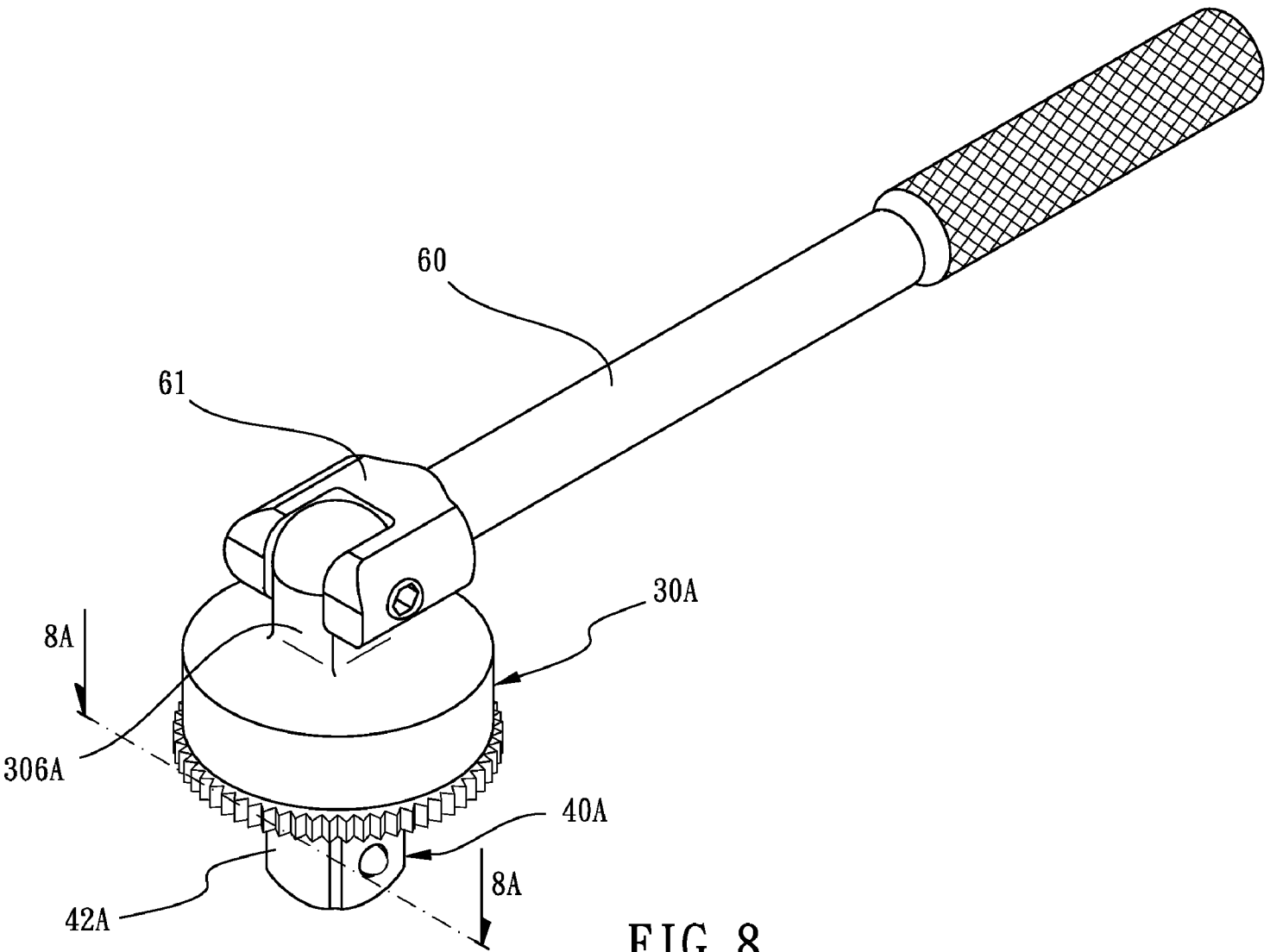
FIG. 8 is a perspective view of the second embodiment of the present invention.
Figure 8A:
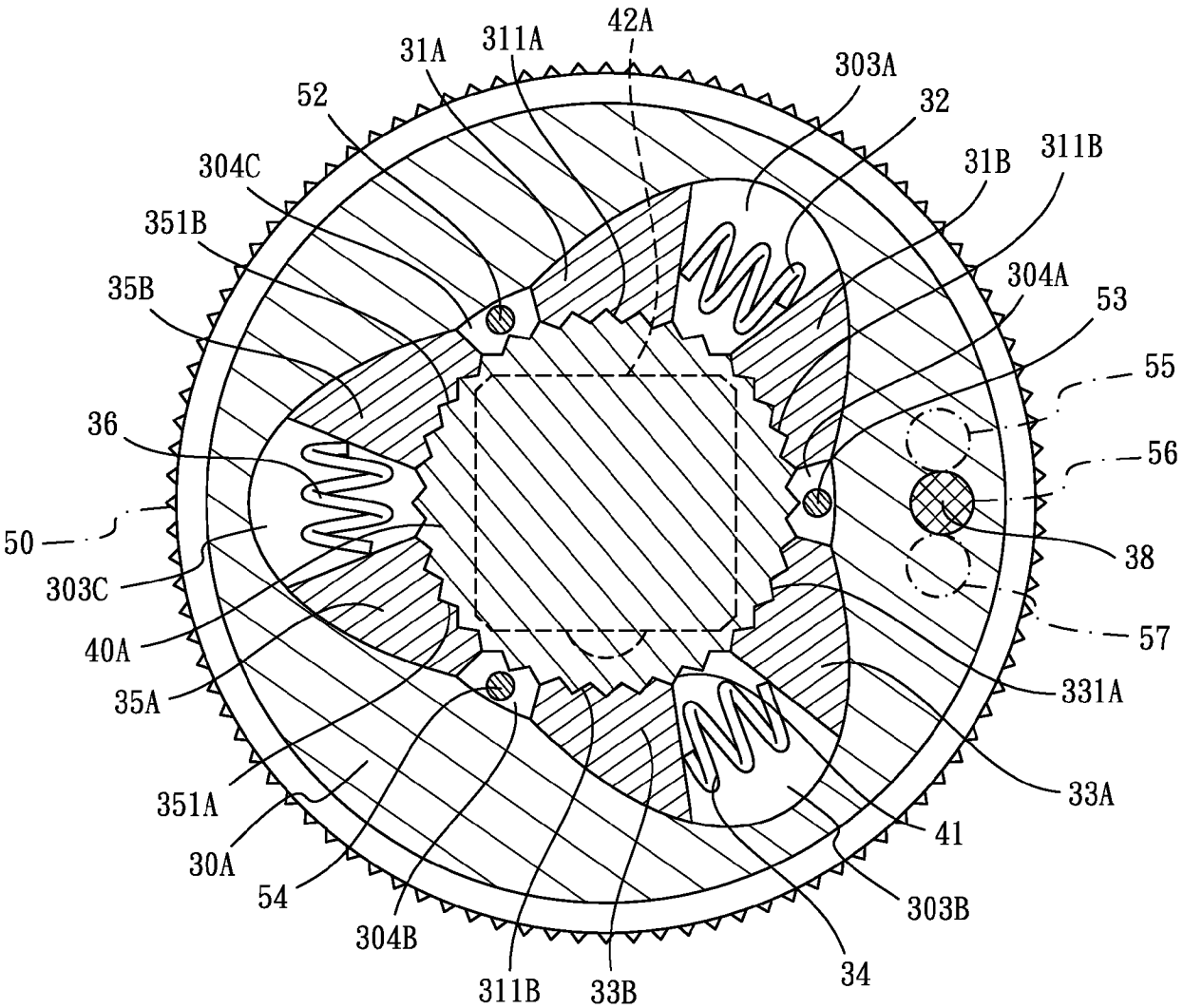
FIG. 8A is a cross-sectional view along line 8A-8A in FIG. 8 of the second embodiment.

Referring to FIGS. 8-8A, the differences of the second embodiment is described as following. A connecting portion 306A is extruded from the top plane of a control unit 30A. A pivot rod 60 is pivoted on the connecting portion 3 06A via a connecting end 61. A ratchet unit 40A is mounted to the control unit 3 OA. A spindle 42A is formed at the head of the ratchet unit 40A for connecting the tool bit (not shown) to the ratchet unit 40A. The user handles the pivot rod 60 for operating via the ratchet unit 40A.

Figure 9:
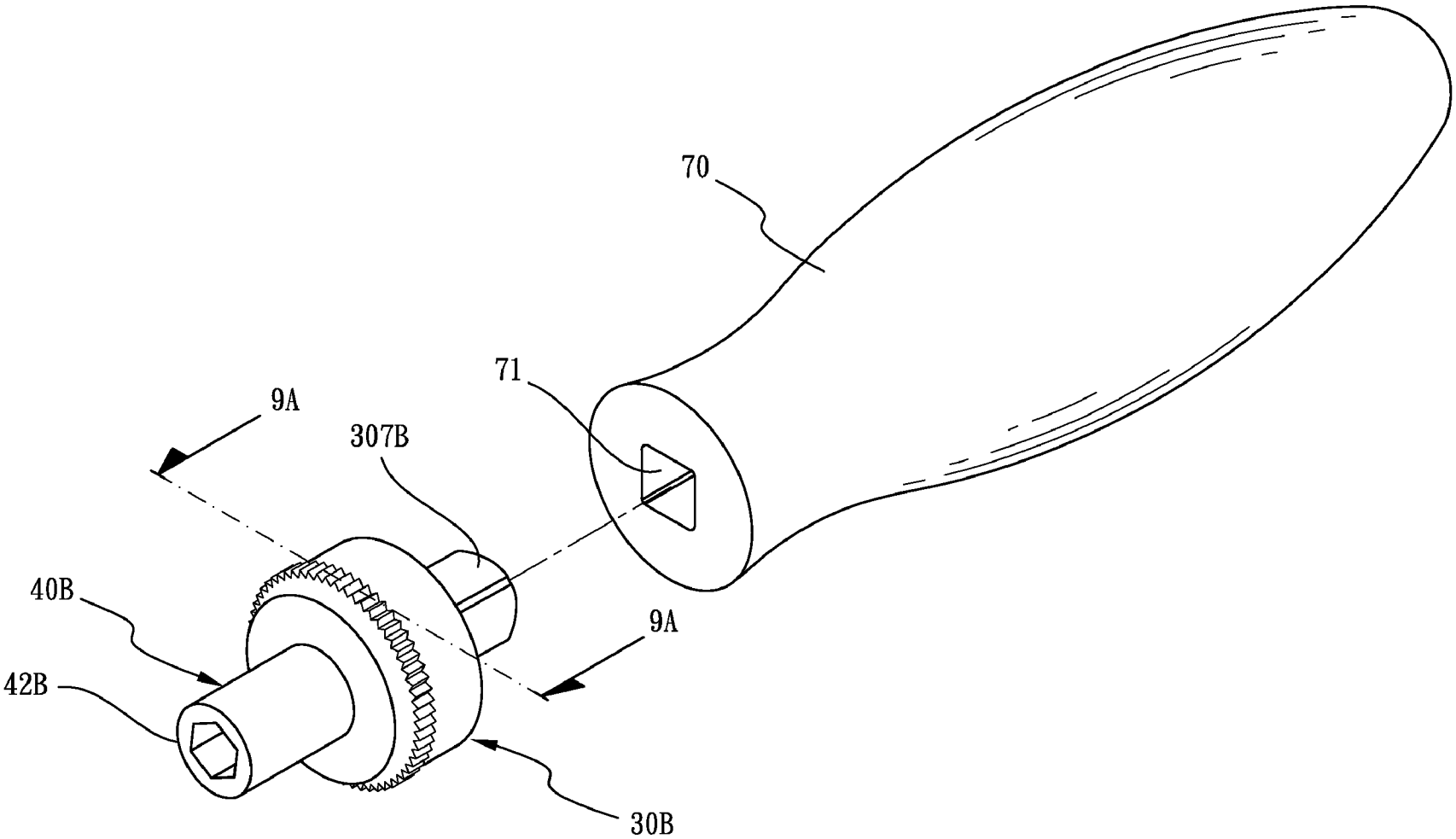
FIG. 9 is a perspective view of the third embodiment of the present invention.
Figure 9A:
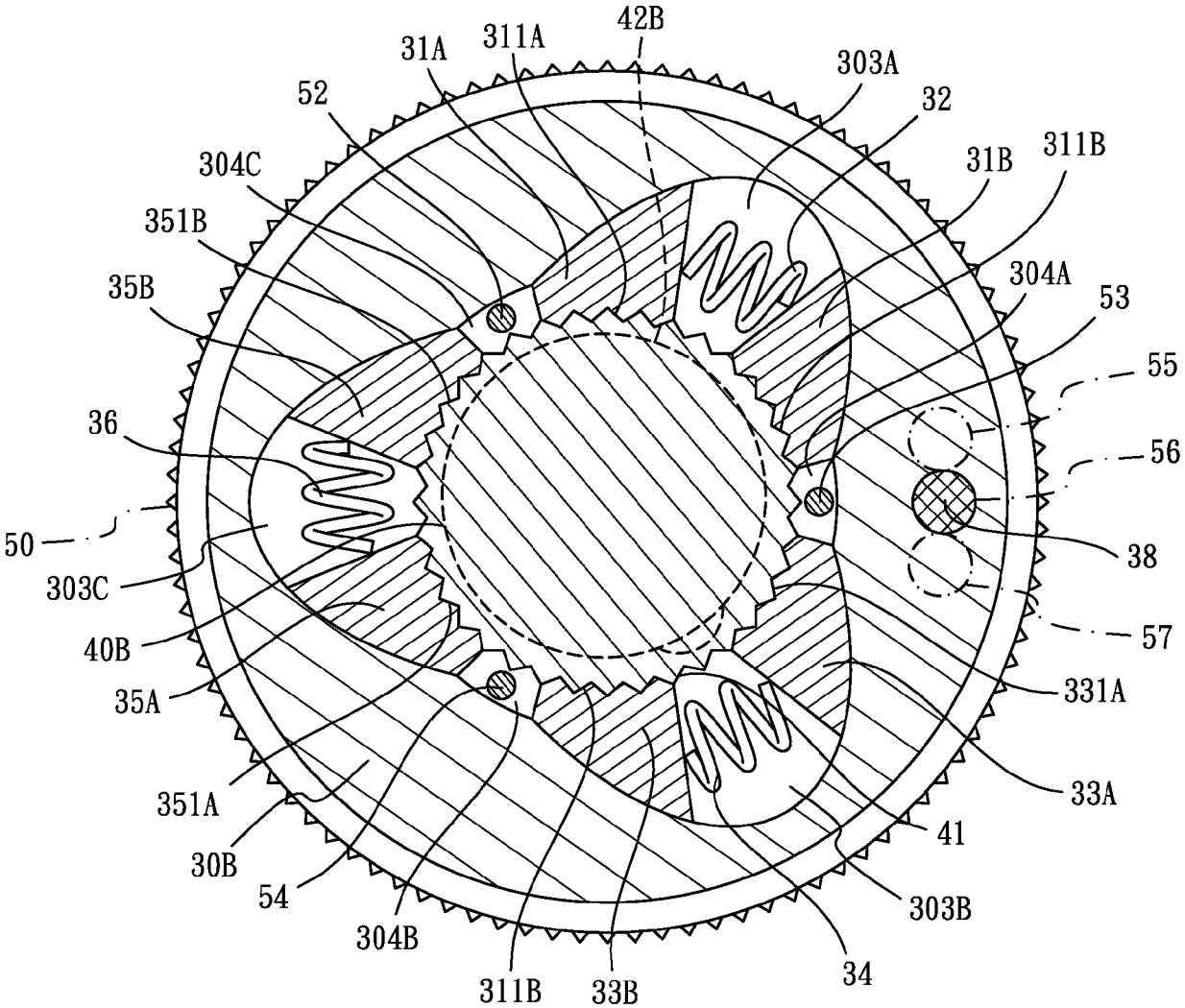
FIG. 9A is a cross-sectional view along line 9A-9A in FIG. 9 of the third embodiment.

Referring to FIGS. 9-9A, the differences of the third embodiment is described as following. A connecting portion 307B is extruded from the top plane of a control unit 30B. The cross-section of the connecting portion 307B is polygon-shaped. A handle bar 70 has a first connecting hole 71 opened at one end thereof. The cross-section of the first connecting hole 71 is polygon-shaped. The connecting portion 307B of the control unit 30B is inserted into the first connecting hole 71 of the handle bar 70 for connecting the control unit 30B to the handle bar 70, so that when the user rotates the handle bar 70 to operate, the control unit 30B rotates with the rotation of the handle bar 70. A ratchet unit 40B is mounted to the control unit 3 OB. A second connecting hole 42B is opened at the head of the ratchet unit 40B. The cross-section of the second connecting hole 42B is hexagon-shaped. The second connecting hole 42B encircles the tool bit for connecting the tool bit to the ratchet unit 40B. The user handles the handle bar 70 for operating via the ratchet unit 40B.

Although the invention has been explained in relation to its preferred embodiment, it is to be understood that many other possible modifications and variations can be made without departing from the spirit and scope of the invention as hereinafter claimed.

What is claimed is:

1. A ratchet device with stable structure comprising:

a control unit, at least three receiving spaces defined on the top plane of the control unit, the receiving spaces communicating with each other, a pair of blockers and a elastomer located in each receiving space;

a ratchet unit connected to the control unit, the ratchet unit having a spindle formed at one end thereof, a plurality of teeth formed around the periphery of the ratchet unit, the teeth engaged with the blockers of the control unit; and a switching unit connected to the ratchet unit, at least three push sticks extruded from the bottom of the switching unit for pushing against the blockers.

2. The ratchet device with stable structure as claimed in claim 1, wherein at least three receiving grooves are respectively defined between each two of the receiving spaces and the receiving grooves are respectively corresponding to the corresponding push sticks of the switching unit.

3. The ratchet device with stable structure as claimed in claim 1, wherein the receiving spaces are symmetrical to each other.

4. The ratchet device with stable structure as claimed in claim 1, wherein the cross-section of each one of the receiving spaces is almost triangle-shaped.

5. The ratchet device with stable structure as claimed in claim 1, wherein each blocker has an engaging portion.

6. The ratchet device with stable structure as claimed in claim 1, wherein each elastomer of the control unit is a spring.

7. The ratchet device with stable structure as claimed in claim 1, wherein a receiving hole is opened on the top plane of the control unit for receiving a fourth elastomer and a bead; three engaging grooves are defined on the bottom of the switching unit; the bead of the control unit is selectively engaged with one of the engaging grooves.

8. The ratchet device with stable structure as claimed in claim 1, wherein a first central hole is opened on the control unit therethrough;

the cross-section of the spindle of the ratchet unit is tetragon-shaped; a second circular groove is defined around the periphery of the spindle;

the spindle passes through the first central hole of the control unit; a first connecting ring is engaged with the second circular groove of the spindle for connecting the spindle to the control unit.

9. The ratchet device with stable structure as claimed in claim 8, wherein the first connecting ring has a notch.

10. The ratchet device with stable structure as claimed in claim 1, wherein the ratchet unit has a cylindrical-shaped connecting end formed at another end thereof; a first circular groove is defined around the periphery of the connecting end; a second central hole is opened through the switching unit; the switching unit encircles the connecting end of the ratchet unit via the second central hole; a second connecting ring is engaged with the first circular groove of the ratchet unit for connecting the switching unit to the ratchet unit.

11. The ratchet device with stable structure as claimed in claim 10, wherein the second connecting ring has a notch.

12. The ratchet device with stable structure as claimed in claim 1, wherein a rod is extruded on the outside periphery of the control unit.

13. The ratchet device with stable structure as claimed in claim 1, wherein a connecting portion is extruded from the top plane of a control unit; a pivot rod is pivoted on the connecting portion.

14. The ratchet device with stable structure as claimed in claim 1, wherein a connecting portion is extruded from the top plane of a control unit for connecting the control unit to a handle bar; a ratchet unit is mounted to the control unit; a second connecting hole is opened at the head of the ratchet unit; the cross-section of the second connecting hole is hexagon-shaped; the second connecting hole encircles the tool bit for connecting the tool bit to the ratchet unit.

15. The ratchet device with stable structure as claimed in claim 14, wherein the cross-section of the connecting portion is polygon-shaped; the handle bar has a first connecting hole opened at one end thereof; the cross-section of the first connecting hole is polygon-shaped; the connecting portion of the control unit is inserted into the first connecting hole of the handle bar for connecting the control unit to the handle bar.

* * * * *